US007676993B2

(12) United States Patent
Bonshor

(10) Patent No.: US 7,676,993 B2
(45) **Date of Patent: *Mar. 16, 2010**

(54) EXTERIOR SIDING MOUNTING BRACKET ASSEMBLY AND METHOD OF ASSEMBLY

(75) Inventor: David James Bonshor, Surrey (CA)

(73) Assignee: Tapco International Corporation, Wixom, MI (US)

( * ) Notice: Subject to any disclaimer, the term of this patent is extended or adjusted under 35 U.S.C. 154(b) by 723 days.

This patent is subject to a terminal disclaimer.

(21) Appl. No.: 11/423,849

(22) Filed: Jun. 13, 2006

(65) Prior Publication Data

US 2006/0277857 A1 Dec. 14, 2006

Related U.S. Application Data

(60) Provisional application No. 60/689,343, filed on Jun. 13, 2005.

(51) Int. Cl.
*E04D 1/36* (2006.01)

(52) U.S. Cl. ..... 52/61; 52/97

(58) Field of Classification Search ..... 52/198, 52/60, 61, 199, 212, 204.54, 473, 716.2, 52/220.8, 302.6, 209, 11, 12, 13, 14, 15, 52/16

See application file for complete search history.

(56) References Cited

U.S. PATENT DOCUMENTS 2,777,405 A * 1/1957 Ager ..... 52/16
4,112,691 A * 9/1978 Ebeling et al. ..... 405/119
4,381,063 A 4/1983 Leong
4,391,068 A * 7/1983 Kosar ..... 52/97
4,646,488 A 3/1987 Burns
4,726,152 A 2/1988 Vagedes et al.
4,875,318 A 10/1989 MacLeod et al.
4,920,708 A * 5/1990 MacLeod et al. ..... 52/60
4,956,948 A * 9/1990 Hart ..... 52/16
5,000,409 A 3/1991 MacLeod et al.
5,018,333 A 5/1991 Bruhm
5,133,165 A 7/1992 Wimberly (Continued)

OTHER PUBLICATIONS

Nurenberg et al., U.S. Appl. No. 12/147,305, filed Jun. 27, 2008, 56 pages.

(Continued)

*Primary Examiner*—Brian E Glessner
*Assistant Examiner*—Adriana Figueroa
(74) *Attorney, Agent, or Firm*—Howard & Howard Attorneys PLLC

(57) ABSTRACT

An exterior siding mounting bracket assembly used in conjunction with siding placed over sheathing of an exterior wall has a base member having a mounting flange fastened to the sheathing and a water diversion fitting also fastened to the sheathing and flashed in-part beneath the lower end of the mounting flange. A wall arrangement projects laterally outward from the mounting flange and away from the sheathing. A trim member of the bracket assembly has a partition arrangement that preferably snap fits to the wall arrangement and a trim flange constructed and arranged to substantially cover the water diversion fitting and the cut edges of the siding that cover in-part the mounting flange. Preferably, the water diversion fitting has an elongated drip edge spaced outwardly from the siding to shed water collected from generally cascaded from the mounting flange and outward from the siding.

27 Claims, 4 Drawing Sheets

U.S. PATENT DOCUMENTS 5,303,522 A 4/1994 Vagedes
5,326,060 A 7/1994 Chubb et al.
5,369,922 A 12/1994 Hansen
5,397,093 A 3/1995 Chubb et al.
5,549,266 A * 8/1996 Mitchell et al. ..... 248/205.1
5,594,206 A 1/1997 Klas et al.
5,675,940 A 10/1997 Bahar et al.
5,722,208 A * 3/1998 Humphrey et al. ..... 52/220.8
5,918,431 A 7/1999 Schiedegger et al.
6,070,375 A 6/2000 Anderson et al.
6,076,310 A 6/2000 Kim
6,098,343 A * 8/2000 Brown et al. ..... 52/11
6,119,416 A 9/2000 Larson
6,151,838 A 11/2000 Husein
6,155,008 A 12/2000 McKee
6,429,371 B2 8/2002 Schiedegger et al.
6,553,735 B1 4/2003 Wang Chen
D475,440 S * 6/2003 Sawyer ..... D23/267
6,610,927 B2 8/2003 Dinh et al.
6,780,100 B1 8/2004 Gretz
6,825,414 B2 11/2004 Vagedes
6,904,725 B1 6/2005 Hansen et al.
6,951,081 B2 * 10/2005 Bonshor ..... 52/97
RE38,881 E * 11/2005 Chubb et al. ..... 248/231.9
7,096,627 B2 * 8/2006 Wade ..... 52/12
7,107,736 B2 9/2006 Barnard
7,408,111 B2 8/2008 Clark et al.
2001/0015281 A1 8/2001 Schiedegger et al.
2003/0041539 A1 3/2003 Bernacki et al.
2003/0136060 A1 * 7/2003 Bonshor ..... 52/97
2006/0213132 A1 9/2006 Bonshor
2006/0260216 A1 11/2006 Bonshor
2006/0261636 A1 11/2006 Bonshor
2006/0277857 A1 * 12/2006 Bonshor ..... 52/518
2007/0044393 A1 3/2007 Bonshor
2007/0044401 A1 3/2007 Bonshor
2007/0175168 A1 8/2007 Bonshor
2008/0149792 A1 6/2008 Nurenburg et al.

OTHER PUBLICATIONS

Bonshor, U.S. Appl. No. 12/390,154, filed Feb. 20, 2009, 12 pages.

* cited by examiner

EXTERIOR SIDING MOUNTING BRACKET ASSEMBLY AND METHOD OF ASSEMBLY

RELATED APPLICATIONS

This patent application claims priority to and all advantages of U.S. Provisional Patent Application No. 60/689,343 which was filed on Jun. 13, 2005.

FIELD OF THE INVENTION

The subject invention generally relates to an exterior siding mounting bracket assembly and more particularly to a water diversion fitting used in conjunction with the mounting bracket for the diversion of water and method of assembling the same.

BACKGROUND OF THE INVENTION

Especially common in residential building structures, the sheathing of exterior walls are known to be covered with a siding material typically made of aluminum, plastic, cedar or other synthetic material often made to appear like wood. Often, various exterior appendages of the home such as cloths dryer vents, exterior light fixtures, electrical outlets, and water spigots must be trimmed-out for aesthetic reasons. This is commonly done with a mounting bracket. One such example of a known mounting bracket is taught in U.S. Pat. No. 4,920,708, assigned to the same assignee as the present invention and incorporated herein by reference in its entirety. The known mounting bracket has an internal base member that snap fits to an external trim member along an axis disposed perpendicular to the sheathing and during assembly. The base member has a continuous flange that projects radially outward and is typically nailed to the sheathing. Projecting axially or laterally outward from the flange and to an inner central panel is a continuous wall. Generally, the wall defines the perimeter of the central panel. A cutout communicates through the panel and has a shape generally dictated by the appendage projecting through it.

The trim member has a continuous partition that projects laterally and axially inward toward the base member, and an aesthetically pleasing flange that projects radially outward from the partition. An opening is generally defined by the partition and receives the wall and panel when the bracket is assembled. The partition is generally shaped to conform with the wall. Multi-positional snap fit features are known to be carried between a radially outward surface of the wall and a radially inward surface of the partition. When the bracket is assembled, the close proximity of the partition to the wall causes the feature to lock the partition and wall together.

During construction of the building, once the base member is secured to the wall, the siding material is installed over the wall and over the flange. The siding, however, must be trimmed so that it is slightly spaced from the continuous wall of the base member. This spacing allows room for entry of the continuous partition of the trim piece, yet is close enough to the wall so that the ends are aesthetically concealed by the outer flange of the trim member which is substantially flush to the siding. Unfortunately, the siding is typically exposed to rain or water which flows down the siding and beneath the exterior flange. This water can accumulate and seep into the concealed ends of the siding and seep further down to the inner flange of the base member exposing the sheathing to moisture. The retained moisture can potentially create a host of problems including the rot of wood, disintegration of simulated materials and the attraction of unwanted insects.

SUMMARY OF THE INVENTION AND ADVANTAGES

An exterior siding mounting bracket assembly used in conjunction with siding placed over sheathing of an exterior wall has a base member having a mounting flange fastened to the sheathing and a water diversion fitting also fastened to the sheathing and flashed in-part beneath the lower end of the mounting flange. A wall arrangement projects laterally outward from the mounting flange and away from the sheathing. A trim member of the bracket assembly has a partition arrangement that preferably snap fits to the wall arrangement and a trim flange constructed and arranged to substantially cover the water diversion fitting and the cut edges of the siding that cover in-part the mounting flange. Preferably, the water diversion fitting has an elongated drip edge spaced outwardly from the siding to shed water collected from generally cascaded from the mounting flange and outward from the siding.

Preferably, the water diversion fitting has a back panel having an upper segment that is orientated at least in-part beneath left and right portions of the mounting flange. A substantially horizontal shelf of the fitting carries the distal drip edge and is spaced below the wall arrangement. Sloped wings at both ends of the shelf of the fitting catch water cascaded from the side portions and diverts the flow upon the shelf. Both ends of the shelf have water dams to assure all water flows over the drip edge and not over the ends of the shelf. Preferably, a series of sloped ribs are formed on each side portion of the mounting flange to further channel water radially inward and generally against the wall arrangement.

Features, advantages and benefits of the present invention include a mounting bracket assembly with improved water shedding capabilities that eliminates or reduces exposure of the sheathing to moisture that could cause damage to structural material and potentially attract unwanted insects. Other advantages include the reduction or elimination of structural maintenance, a bracket assembly design that is relatively simple, robust and versatile, and a bracket assembly that is inexpensive to manufacture and easy to install.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
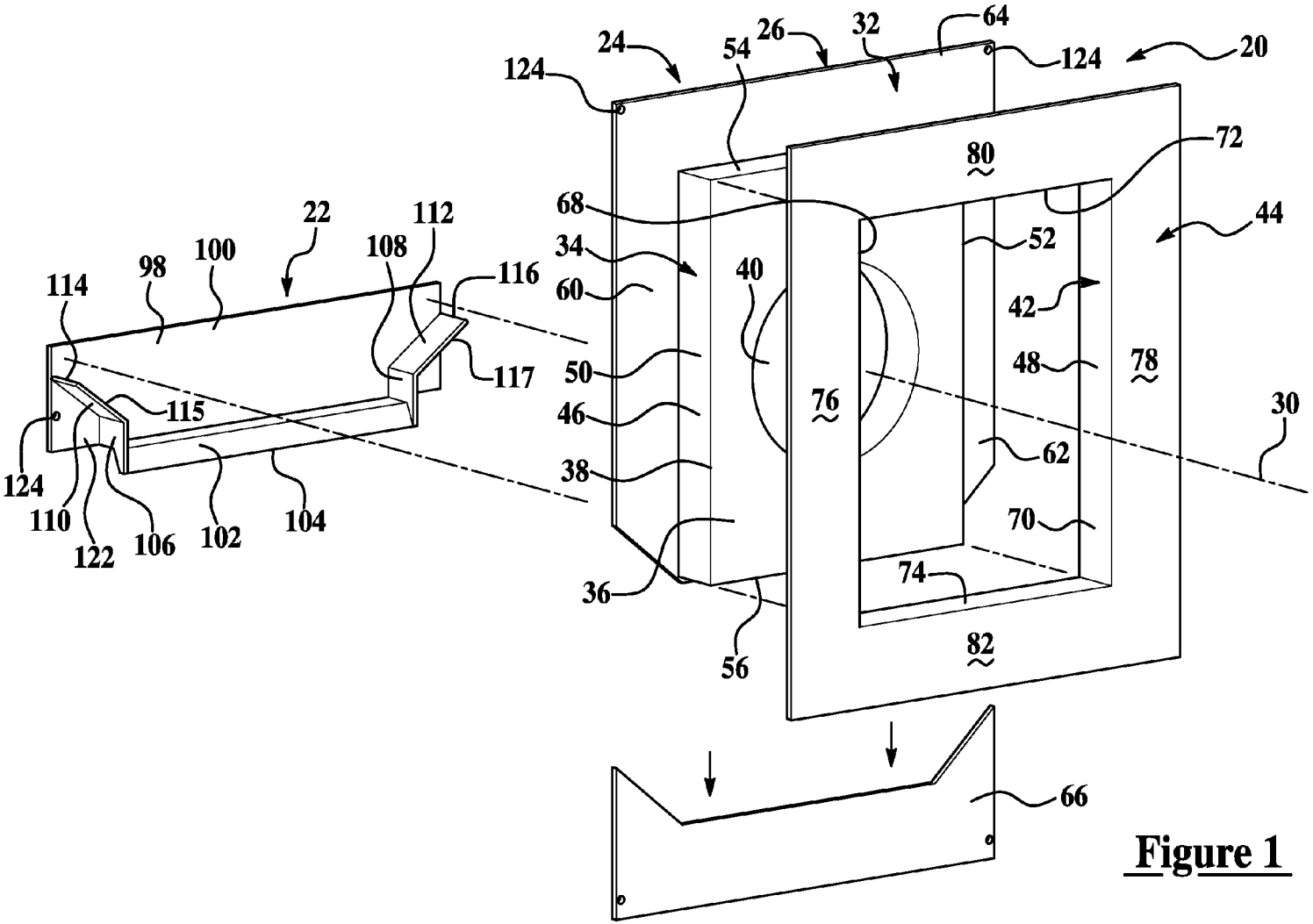
FIG. 1 is an exploded perspective view of a mounting bracket assembly embodying the present invention.
Figure 2:
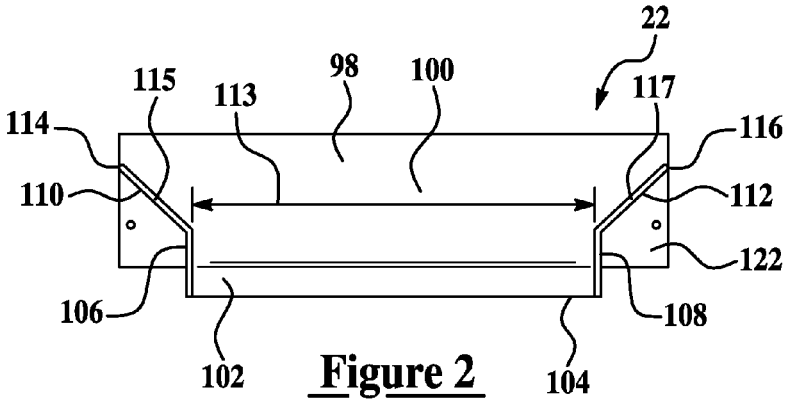
FIG. 2 is a front view of a water diversion fitting of the bracket assembly.
Figure 3:
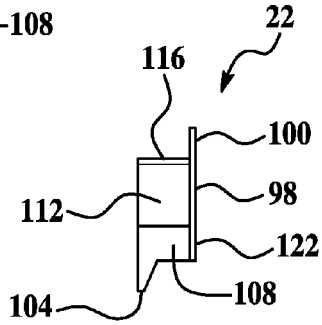
FIG. 3 is a side view of the water diversion fitting.

As best illustrated in FIGS. 1-5, a mounting bracket assembly 20 embodying the present invention generally projects or is exposed through exterior siding (not shown) of a substantially vertical wall of any variety of buildings or residential structures exposed to inclement weather such as rain and generally water runoff. The assembly 20 provides an aesthetically pleasing surface for which any variety of exterior components can be easily mounted or project therefrom. Such components include but are not limited to hose spigots, electrical receptacles, clothes dryer vents, and light fixtures.

The assembly 20 is fastened to a substructure of the exterior wall preferably prior to placement of the siding. The substructure is generally an underlayment or sheathing that is preferably covered with the siding material. The mounting bracket assembly 20 is generally self-flashing for the prevention of water seepage beneath the siding. The assembly 20 preferably has water diversion fitting 22 and a mounting bracket 24 both preferably and independently secured to the sheathing. The mounting bracket 24 has a base member 26 secured to the sheathing and a trim member 28 that preferably snap fits to the base member 26 along an axis 30 preferably disposed substantially perpendicular to the sheathing.

Figure 4:
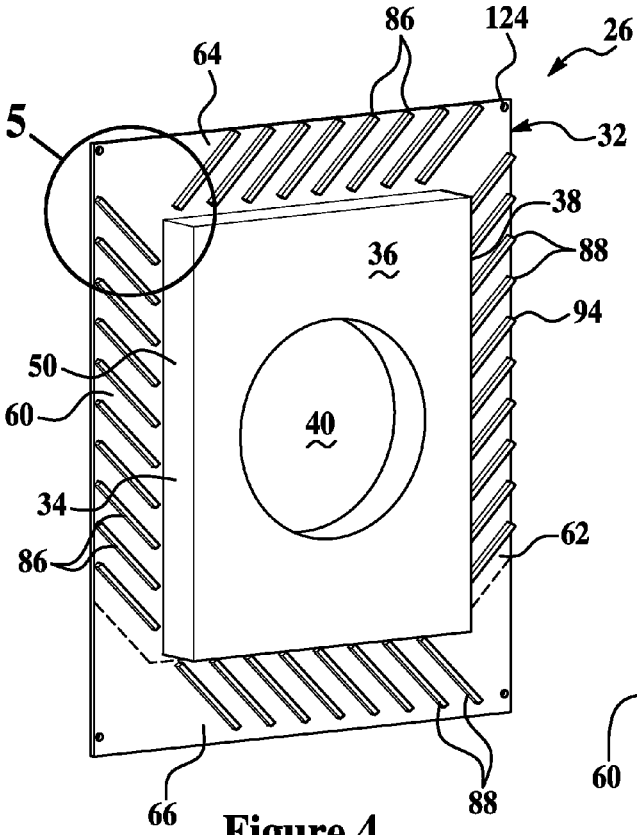
FIG. 4 is a perspective view of a base member of the bracket assembly.
Figure 5:
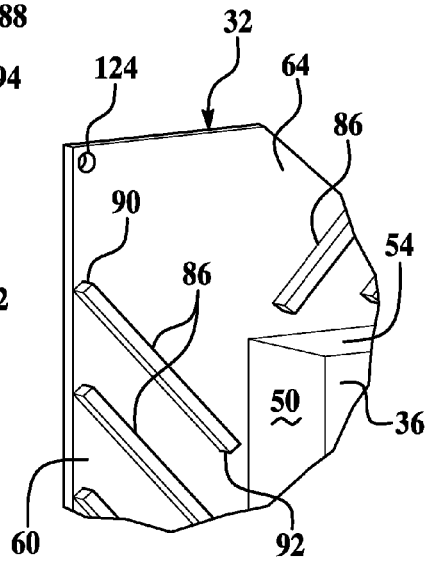
FIG. 5 is an enlarged perspective view of the base member taken from circle 5 of FIG. 4.
Figure 6:
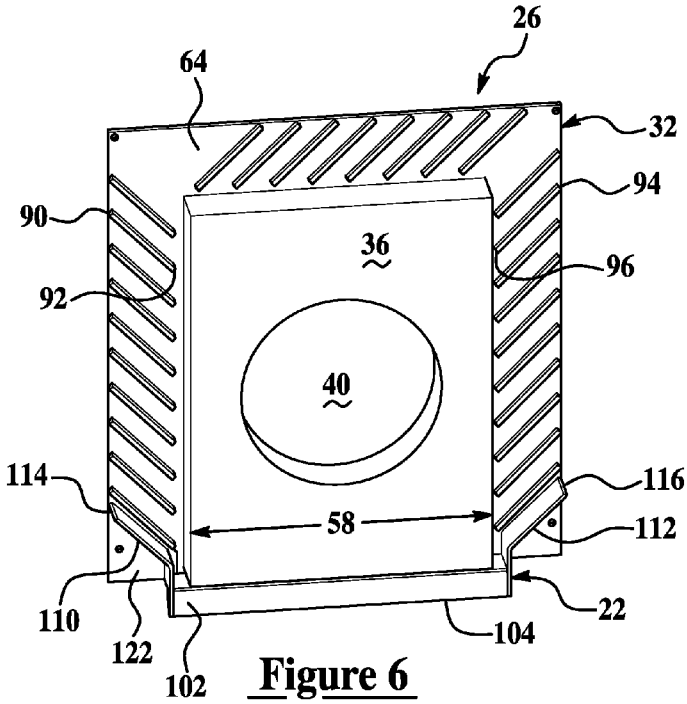
FIG. 6 is a perspective view of the bracket assembly with a trim member removed to show internal detail.
Figure 7:
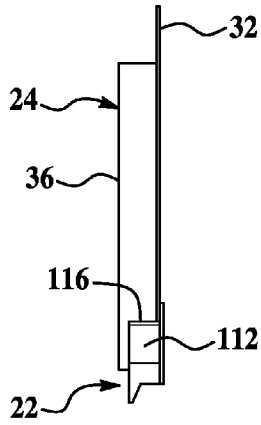
FIG. 7 is a side view of the bracket assembly with the trim member removed.

The base member 26 has mounting flange 32 and a preferably continuous wall arrangement 34 (see FIGS. 4-6). The flange 32 projects radially outward from the wall arrangement 34 and is typically nailed to the sheathing. The wall arrangement 34 projects axially or laterally outward from the flange 32 and preferably to a radially inward central panel 36 spaced from and orientated substantially parallel to the underlayment. Generally, the central panel 36 is that portion of the base member 26 that is exposed through the siding with the wall arrangement 34 defining or carrying a perimeter 38 of the central panel 36 at it's distal edge. A cutout 40 preferably communicates through the panel 36 and has a shape generally dictated by the component or appendage projecting through it (not shown).

Figure 8:
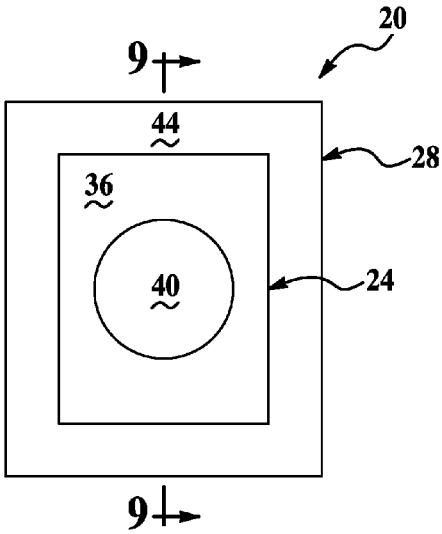
FIG. 8 is a front view of the bracket assembly.
Figure 9:
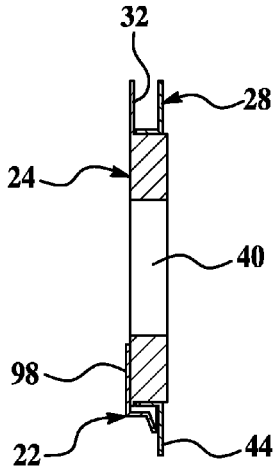
FIG. 9 is a cross section of the bracket assembly taken along line 9-9 of FIG. 8.

Referring to FIGS. 1 and 8-9, the trim member 28 preferably has a continuous partition arrangement 42 that projects laterally and/or axially inward toward the base member 26, and an aesthetically pleasing exterior flange 44 that projects radially outward from the partition arrangement 42. The partition arrangement 42 is generally shaped to conform with the wall arrangement 34. Multi-positional snap fit features (not shown) are preferably carried between a radially outward surface 46 of the wall arrangement 34 and a radially inward surface 48 of the partition arrangement 42. When the bracket 24 is assembled, the close proximity of the partition arrangement 42 to the wall arrangement 34 causes the feature to lock the partition and wall arrangements together at an axial orientation generally dictated by the thickness of the siding.

Referring to FIGS. 1, 4 and 6-7, preferably the wall arrangement 34 of the base member 26 forms a rectangular or square shape having a left side wall 50, a right side wall 52, a top wall 54 and a bottom wall 56. The side wall 50, 52 are substantially vertical and the top and bottom wall 54, 56 are substantially horizontal. The top wall 54 extends longitudinally between top ends of respective left and right side walls 50, 52 thus having a longitudinal length that is generally equal to a spatial distance 58 measured between the side walls 50, 52 (see FIG. 6). The flange 32 of the base member 26 has a left portion 60 associated with the left side wall 50, a right portion 62 associated with the right side wall 52, a top portion 64 associated with the top wall 54, and preferably a removable bottom portion 66 associated with the bottom wall 56. One skilled in the art, however, would now realize that the continuous wall arrangement 34 may take the form of any shape including but not limited to that of a circle, oval, octagon and hexagon. Moreover, one skilled in the art would also now realize that the bottom wall 56 could be omitted because it does not necessarily contribute toward water drain-off, however, rigidity of the central panel 36 could potentially be degraded.

Referring to FIGS. 1 and 8-9, preferably the partition arrangement 42 of the trim member 28 conforms generally in shape to the wall arrangement 34, thus preferably having a left side partition 68, a right side partition 70, a top partition 72 and a bottom partition 74. The side partitions 68, 70 are substantially vertical and the top and bottom partitions 72, 74 are substantially horizontal. The aesthetically pleasing exterior flange 44 of the trim member 28 has a left portion 76 associated with the left side partition 68, a right portion 78 associated with the right side partition 70, a top portion 80 associated with the top partition 72, and preferably a bottom portion 82 associated with the bottom partition 74.

Referring to FIG. 4, water channeling characteristics or oppositely sloped ribs 86, 88 of the mounting bracket 24 are preferably formed into all portions 60, 62, 64, 66 of the mounting flange 32 of the base member 26 so that the member 26 can be selectively mounted to the sheathing in one of two positions. The two positions are rotationally displaced by about ninety degrees from each other with respect to the axis 30. That is, the left portion 60 could be the bottom portion (not illustrated) if selected. For simplicity of explanation, the ribs 86, 88 shall be described relative to the left and right portions 60, 62 only, since the ribs 86, 88 formed to the top and bottom portion 64, 66 generally serve no functional purpose once the position of the mounting position of the base member 26 is selected by the installer.

The first set of ribs 86 each have a negative slope at preferably about forty-five degrees, and are generally stacked and spaced vertically from one-another. Each rib 86 extends longitudinally between an outer end 90 proximate to the radially outward periphery of the left portion 60 of the flange 32 and an opposite inner end 92 located below and radially inward from the outer end 90 with respect to axis 30. The inner end 92 is spaced radially outward from the left side wall 50 of the wall arrangement 34 to prevent water damming or collection beneath the siding and generally between the rib 86 and the left side wall 50. The second set of ribs 88 each have a positive slope at preferably about forty-five degrees, and are generally stacked and spaced vertically from one-another. Each rib 88 extends longitudinally between an outer end 94 proximate to the radially outward periphery of the right portion 62 of the flange 32 and an opposite inner end 96 located below and radially inward from the outer end 94 with respect to axis 30. The inner end 96 is spaced radially outward from the right side wall 52 of the wall arrangement 34 to prevent water damming or collection beneath the siding and generally between the rib 88 and the right side wall 52.

In operation and during inclement weather, water intrusion, or rain, water cascading down the siding from above the mounting bracket 24 will flow beneath the exterior flange 44. A portion of this water may flow between the cut ends of the siding and the respective left and right side walls 50, 52 of the base member 26. The propagation of this water in a radially outward direction with respect to axis 30 and beneath the siding is restricted via the ribs 86, 88 which channel the water radially inward and against the respective side walls 50, 52. The ribs 86, 88 also function to space the siding slightly outward from the mounting flange 32 thus preventing water damming directly between the back side of the siding and the flange 32 that could cause moisture propagation in an unwanted radially outward direction instead of the desirable downward direction. The cascading water flowing downward from the ribs 86, 88 generally falls or is captured by the water diversion fitting 22 disposed below.

Referring to FIGS. 1-3 and 6-7, the water diversion fitting 22 is orientated partially beneath and below the base member 26, and as such is generally "flashed" to the base member for receiving gravity fed water run-off generally from the left and right portions 60, 62 of the flange 32 of the base member. Preferably, the fitting 22 has a backing panel 98 having an upper flashing segment 100 that is generally tucked beneath the lower ends of the left and right portions 60, 62 of the flange 32 and preferably beneath the bottom wall 56 of the wall arrangement 34. Projecting laterally outward from the panel 98 and extending longitudinally along and spaced beneath the bottom wall 56 is a water run-off shelf 102 that carries a distal drip edge 104 orientated outward from the siding and spaced slightly inward from the bottom portion 82 of the external flange 44.

Contiguous to each end of the shelf 102 and the panel 98 are left and right end dams 106, 108, and preferably contiguous to the panel 98 and the left and right end dams 106, 108 are respective left and right wings 110, 112. The end dams 106, 108 are spaced apart from one-another by a distance 113 that is preferably slightly greater than the distance 58 between the wall portions 50, 52 (see FIGS. 2 and 6). Preferably, the wings 110, 112 extend radially outward and upward to distal ends 114, 116 located generally directly beneath the outer ends 90, 94 of the respective ribs 86, 88 or located proximate to the radial outer periphery of the left and right portions 60, 62. Water shedding from the left and right ribs 86, 88 flows into the channels 118,120, is directed over the respective end dams 106, 108, and flows upon the shelf 102. Preferably, the lateral projection of the shelf 102 is angled downward so that water cascaded upon the shelf quickly and efficiently flows over the drip edge 104 and preferably clear of the siding below.

Preferably, the left and right wings 110, 112 have longitudinal edges 115, 117 that substantially lie in an imaginary plane with the drip edge 104. The wings 110, 112 are orientated at about a right angle with respect to the panel 98.

During assembly of the mounting bracket assembly 20, a lower segment 122 of the panel 98 located beneath the shelf 102 and wings 110, 112 is fastened to the sheathing preferably with conventional fasteners such as nails or screws inserted through holes 124 in the lower segment. Preferably, the bottom portion 66 of the base member 26 is removed preferably with the use of a cutter or snips along dotted line identified as 125 in FIG. 4. Removal of the bottom portion 66 enables positioning of the water diversion fitting 22 beneath the exterior flange 44 for aesthetic purposes. The trimmed base member 26 is then placed over the fitting 22 and the remaining mounting flange 32 is fastened to the sheathing at a location preferably spaced substantially above the fitting 22. Preferably the upper ends of the left and right portions 60, 62 or the upper corners of the mounting flange 32 carry holes 124 for receipt of nails or screws for this attachment.

With the base member 26 and fitting 22 secured to the sheathing, the siding is appropriately trimmed during installation so that the shelf 102, the left and right wings 110, 112 of the fitting 22 and the wall arrangement 34 of the base member 26 are disposed radially inward from the siding and project axially outward therefrom. The siding material is installed over sheathing and over the flange 32. The siding, however, must be trimmed or cut to create a gap between the cut ends and the side walls 50, 52 of the continuous wall arrangement 34 of the base member 26. This gap allows room for entry of the side partitions 68, 70 of the continuous partition arrangement 42 of the trim member 28, yet is close enough to the wall so that the cut ends are aesthetically concealed by the exterior flange 44 of the trim member 28 which is substantially flush to the siding.

After installation of the siding, the trim member 28 is preferably snap fitted to the base member 26 thereby covering the cut ends of the siding and the fitting 22 for a pleasing appearance. Fitting of the base member 26 to the trim member 28 can be done in any variety of ways including that disclosed in U.S. Pat. No. 5,918,431 assigned to the assignee of the present invention and incorporated herein by reference in it's entirety. The base member 26, the fitting 22 and the trim member 28 are preferably separate components and individually formed of injection molded plastic.

One skilled in the art would now know that a base member 26 can be manufactured with the ribs 86, 88 and without the bottom portion 66 of the flange 32 thus alleviating the installation step of cutting off the bottom portion. This however would dedicate the assembly 20 to one installation position only. Moreover, one skilled in the art would now know that the fitting 22 and the base member 26 can be formed as one unitary piece, however, this would also dedicate the assembly 20 to a singular installation position. The water diversion fitting 22 is versatile because it can be used in conjunction with mounting brackets known to be on the market albeit without ribs 86, 88.

Figure 10:
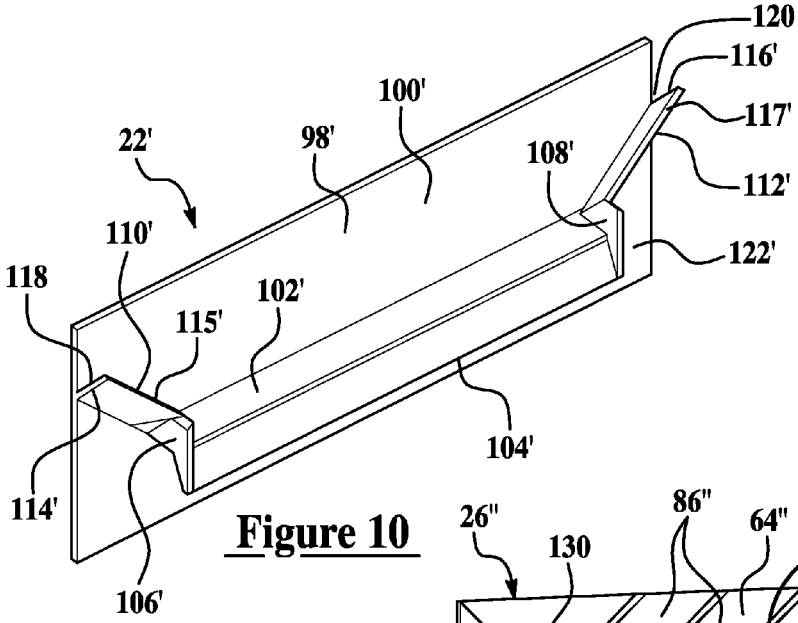
FIG. 10 is a perspective view of a modified water diversion fitting.

Referring to FIG. 10, a modification of a water diversion fitting 22' is illustrated wherein like elements of the first embodiment have the same identifying numerals except with the addition of a single prime symbol. The water diversion fitting 22' has left and right wings 110', 112' which are orientated with an upper segment 100' of a panel 98' to generally form an acute angle. The acute angles generally form respective troughs or channels 118, 120 to enhance the redirection of water flow upon a shelf 102'. The enhanced channeling of water provided by the troughs 118, 120 is such that longitudinal edges 115', 117' can be located closer to the panel 98' than a drip edge 104' carried by a shelf 102'.

Figure 11:
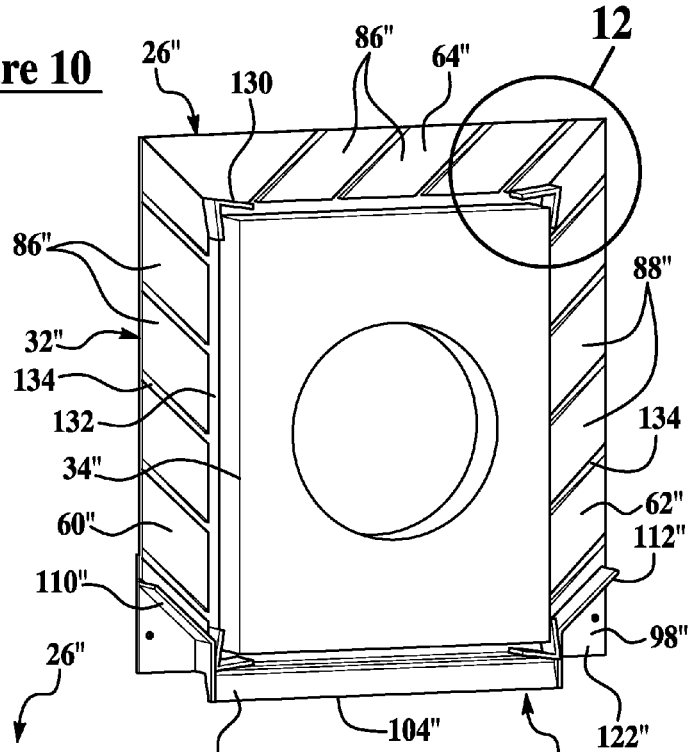
FIG. 11 is a perspective view of the modified water diversion fitting orientated to a modified version of the base member.
Figure 12:
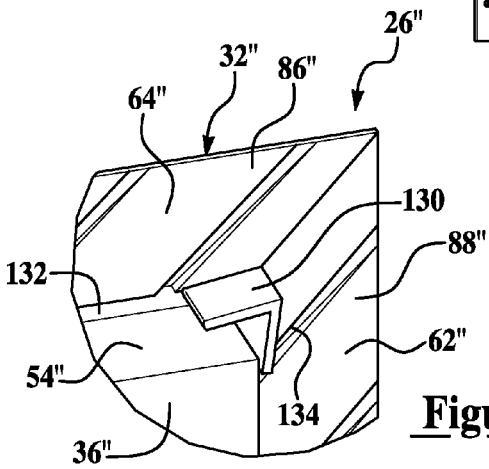
FIG. 12 is an enlarged perspective view of the modified base member taken from circle 12 of FIG. 11.

Referring to FIGS. 11-12, a second modification of a base member 26" is illustrated wherein like elements of the first embodiment have the same identifying numerals except with the addition of a double prime symbol. The base member 26" generally has much wider ribs 86", 88" than base member 26 thus producing the appearance of a peripheral channel 132 that circles and is defined in part by a wall arrangement 34" and a series of communicating slots 134 that are preferably tapered or become deeper as the slots 134 extend radially inward toward the channel 132 for biasing water flow in a radially inward direction. A plurality of bosses or cornices 130 project axially outward from the mounting flange 32" and are preferably proximate to each comer of the wall arrangement 34" and spaced radially outward from the arrangement generally by the continuous channel 132. The cornices 130 restrict axial insertion of the trim member (not shown) upon the base member 26" thus preventing the partition arrangement of the trim member from obstructing water flow in the channel 132.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that reference numerals are utilized merely for convenience and are not to be limiting in any way, and that the invention may be practiced otherwise than as specifically described.

What is claimed is:

1. An exterior siding mounting bracket assembly secured to a substantially vertical substructure of a sided exterior wall and orientated substantially vertical and in-part generally projecting over siding that covers the substructure, the exterior siding mounting bracket assembly comprising:

a water diversion fitting engaged to the substructure, the water diversion fitting having a lower drip edge orientated outward from the siding and an upper flashing segment;

a base member attached to the substructure and having a mounting flange disposed at least in-part beneath the siding and a lower edge disposed over the upper flashing segment with the upper flashing segment adjacent to and extending beneath the base member between the lower edge of the base member and the substrate when the assembly is in an assembled state; and a trim member fitted to the base member and having an outer flange disposed over at least a portion of the siding and spaced outward from the mounting flange.

2. The exterior siding mounting bracket assembly set forth in claim 1 further comprising:

an axis projecting outward from the substructure;

a first portion of the mounting flange extending vertically and spaced radially outward from the axis and spaced above the lower drip edge; and at least one deflector rib formed to and projecting laterally outward from the first portion above the lower edge of the base member and extending longitudinally between a first end and an opposite second end wherein the first end is orientated above and radially outward from the opposite second end.

3. The exterior siding mounting bracket assembly set forth in claim 2 further comprising a wall arrangement of the base member projecting at least in-part axially outward from the first portion and orientated radially inward from the second end.

4. The exterior siding mounting bracket assembly set forth in claim 1 further comprising:

an axis projecting outward from the sheathing;

the mounting flange being continuous when the assembly is in a non-assembled state and having a left side portion, a right side portion disposed diametrically opposite the left side portion, a top portion, and a bottom portion disposed diametrically opposite the top portion;

wherein at least the bottom portion is detachable from the mounting flange along and forming the lower edge and when the assembly is in the assembled state; and the left and right side portions being diametrically opposite to one another, spaced radially outward from the axis, and spaced above the lower drip edge.

5. The exterior siding mounting bracket assembly set forth in claim 4 further comprising:

a left plurality of deflector ribs formed and projecting laterally outward from the left side portion; and a right plurality of deflector ribs formed and projecting laterally outward from the right side portion.

6. The exterior siding mounting bracket assembly set forth in claim 5 further comprising:

a top plurality of deflector ribs formed and projecting laterally outward from the top portion; and a bottom plurality of deflector ribs formed and projecting laterally outward from the bottom portion.

7. The exterior siding mounting bracket assembly set forth in claim 5 further comprising a wall arrangement of the base member projecting at least in-part axially outward from the left and right side portions and the top portion and being spaced radially inward from the left, right and top plurality of deflector ribs.

8. The exterior siding mounting bracket assembly set forth in claim 1 wherein the outer flange covers the water diversion fitting.

9. The exterior siding mounting bracket assembly set forth in claim 5 further comprising an elongated shelf extending horizontally and projecting laterally outwardly from the water diversion fitting to the lower drip edge and oppositely sloped wings projecting outwardly above the elongated shelf along the water diversion fitting below the lower edge of the base member for cascading water from the deflector ribs upon the elongated shelf.

10. The exterior siding mounting bracket assembly set forth in claim 9 wherein the wings slope downwardly toward the elongated shelf.

11. The exterior siding mounting bracket assembly set forth in claim 9 further comprising a first end dam extending from one of the wings and an opposite second end dam extending from the other of the wings with each of the first and second end dams orientated at opposite ends of the elongated shelf and connected to the elongated shelf for channeling water over the drip edge wherein the oppositely sloped wings are contiguous to the first and second end dams.

12. The exterior siding mounting bracket assembly set forth in claim 2 further comprising an elongated shelf extending horizontally and projecting laterally outwardly from the water diversion fitting to the lower drip edge and oppositely sloped wings projecting outwardly above the elongated shelf along the water diversion fitting below the lower edge of the base member for cascading water from the deflector rib upon the elongated shelf.

13. The exterior siding mounting bracket assembly set forth in claim 11 further comprising a first plurality of deflector ribs wherein the at least one deflector rib is one of the first plurality of deflector ribs with each one of the first plurality of deflector ribs being spaced above an adjacent one of the plurality of deflector ribs.

14. The exterior siding mounting bracket assembly set forth in claim 13 further comprising:

a second portion of the mounting flange disposed diametrically opposite the first portion and spaced above the lower drip edge; and a second plurality of deflector ribs formed to and projecting laterally outward from the second portion and sloped opposite with respect to the first plurality of deflector ribs.

15. The exterior siding mounting bracket assembly set forth in claim 12 wherein the wings slope downwardly toward the elongated shelf.

16. The exterior siding mounting bracket assembly set forth in claim 12 further comprising a first end dam extending from one of the wings and an opposite second end dam extending from the other of the wings with each of the first and second end dams orientated at opposite ends of the elongated shelf and connected to the elongated shelf for channeling water over the drip edge wherein the oppositely sloped wings are contiguous to the first and second end dams.

17. A mounting bracket assembly for an exterior wall having a substructure covered by siding, the mounting bracket assembly comprising:

a base member having a mounting flange for attachment to the substructure at least in part beneath the siding, the base member having a front surface for disposition adjacent the siding and a rear surface opposite the front surface for disposition adjacent the substructure;

a water diversion fitting for attachment to the substructure and having an upper flashing segment and an elongated shelf disposed below the upper flashing segment with the elongated shelf extending transversely to the upper flashing segment to a lower drip ledge spaced from the upper flashing segment for channeling water to an exterior side of the siding;

the upper flashing segment of the water diversion fitting extending beneath the base member adjacent the rear surface of the base member for extending between the lower edge of the base member and the substrate when the assembly is in an assembled state; and a trim member selectively coupled to the base member adjacent the front surface and spaced from the mounting flange for concealing an edge of the siding between the trim member and the mounting flange.

18. The mounting bracket assembly set forth in claim 17 further comprising oppositely sloped wings extending transversely from the water diversion fitting and extending along the water diversion fitting transversely to the elongated shelf for cascading water from the base member upon the elongated shelf.

19. The mounting bracket assembly set forth in claim 18 further comprising a first end dam extending transversely from the water diversion fitting from one of the sloped wings to the elongated shelf and a second end dam extending transversely from the water diversion fitting from the other of the sloped wings to the elongated shelf.

20. The mounting bracket assembly as set forth in claim 17 further comprising a first portion of the mounting flange extending vertically and spaced radially outward from the axis and spaced above the lower drip edge; and a first plurality of deflector ribs wherein the at least one deflector rib is one of the first plurality of deflector ribs with each one of the first plurality of deflector ribs being spaced above an adjacent one of the plurality of deflector ribs.

21. The mounting bracket assembly set forth in claim 20 further comprising:

a second portion of the mounting flange disposed diametrically opposite the first portion and spaced above the lower drip edge; and a second plurality of deflector ribs formed to and projecting laterally outward from the second portion and sloped opposite with respect to the first plurality of deflector ribs.

22. The mounting bracket assembly set forth in claim 21 further comprising a wall arrangement of the base member projecting at least in-part axially outward from the first and second portions and orientated radially inward from the first and second portions.

23. The mounting bracket assembly set forth in claim 17 wherein the mounting flange includes a left side portion, a right side portion disposed diametrically opposite the first portion, a top portion, and a bottom portion disposed diametrically opposite the top portion and wherein the left and right side portions and the top portion are disposed above the lower drip edge.

24. The mounting bracket assembly set forth in claim 23 further comprising:

a left plurality of deflector ribs formed and projecting laterally outward from the left side portion; and a right plurality of deflector ribs formed and projecting laterally outward from the right side portion.

25. The mounting bracket assembly set forth in claim 24 further comprising:

a top plurality of deflector ribs formed and projecting laterally outward from the top portion; and a bottom plurality of deflector ribs formed and projecting laterally outward from the bottom portion.

26. The mounting bracket assembly set forth in claim 25 further comprising a wall arrangement of the base member projecting at least in-part axially outward from the left and right side portions and the top portion and being spaced radially inward from the left, right and top plurality of deflector ribs.

27. The mounting bracket assembly as set forth in claim 23 wherein at least the bottom portion is detachable from the mounting flange along and forming the lower edge.

* * * * *

UNITED STATES PATENT AND TRADEMARK OFFICE

CERTIFICATE OF CORRECTION

PATENT NO. : 7,676,993 B2
APPLICATION NO. : 11/423849
DATED : March 16, 2010
INVENTOR(S) : David James Bonshor It is certified that error appears in the above-identified patent and that said Letters Patent is hereby corrected as shown below:

Column 7, line 48, Claim 4, delete "sheathing" and insert -- substructure --;

Column 8, line 42, Claim 13, delete "claim 11", and insert -- claim 12 --; and

Column 9, line 13, Claim 17, delete "ledge" and insert -- edge --.

Signed and Sealed this

Eighth Day of June, 2010

David J. Kappos

David J. Kappos
*Director of the United States Patent and Trademark Office*